US005182896A

United States Patent [19]

Maccherone

[11] Patent Number: 5,182,896

[45] Date of Patent: Feb. 2, 1993

[54] APPARATUS AND METHOD FOR HEAT-SEALING A FILM COVER TO OPEN ENDED CONTAINERS

[75] Inventor: Larry Maccherone, Severna Park, Md.

[73] Assignee: Sweetheart Cup Company Inc., Owings Mills, Md.

[21] Appl. No.: 756,189

[22] Filed: Sep. 9, 1991

[51] Int. Cl.[5] ..... B65B 51/10

[52] U.S. Cl. ..... 53/478; 53/298; 53/329.5; 53/389.4; 83/596; 156/267; 156/522

[58] Field of Search ..... 53/51, 296, 297, 298, 53/329.2, 329.3, 329.4, 329.5, 389.3, 389.4, 478, 487; 242/65, 67.1 R, 67.3 R; 83/591, 596, 490; 156/267, 522

[56] References Cited

U.S. PATENT DOCUMENTS

| | | | |
|---|---|---|---|
| 3,112,587 | 12/1963 | Anderson et al. | 53/487 X |
| 3,126,798 | 3/1964 | Fairchild | 93/55.1 |
| 3,195,284 | 7/1965 | Crane, Jr. | 53/30 |
| 3,267,639 | 8/1966 | Ollier et al. | 53/51 |
| 3,322,604 | 5/1967 | Schott, Jr. | 156/583.5 X |
| 3,378,991 | 4/1968 | Anderson | 53/373 |
| 3,509,682 | 5/1970 | Logemann | 53/329.5 X |
| 3,706,175 | 12/1972 | Anderson | 53/22 |
| 3,743,567 | 7/1973 | Abler | 156/553 |
| 3,762,283 | 10/1973 | Renner | 53/137 |
| 3,792,566 | 2/1974 | Kinney | 53/329.5 X |
| 3,838,550 | 10/1974 | Mueller | 53/37 |
| 4,035,987 | 7/1977 | Nakazato et al. | 53/298 X |
| 4,065,908 | 1/1978 | Mueller | 53/14 |
| 4,176,507 | 12/1979 | Mancini | 53/477 |
| 4,358,336 | 11/1982 | Focke et al. | 156/520 X |
| 4,362,002 | 12/1982 | Rowland et al. | 53/478 |
| 4,453,666 | 6/1984 | Gordon | 229/43 |
| 4,568,407 | 2/1986 | Barbieri et al. | 156/523 X |
| 4,625,498 | 12/1986 | Parsons | 53/298 X |
| 4,658,568 | 4/1987 | Reid et al. | 53/329 |
| 4,736,568 | 4/1988 | Shaw et al. | 53/297 |
| 4,925,515 | 3/1990 | Yoshimura et al. | 156/522 X |
| 4,961,513 | 10/1990 | Gossedge et al. | 206/633 |
| 4,978,056 | 12/1990 | Ball et al. | 229/123.1 |

*Primary Examiner*—John Sipos
*Assistant Examiner*—Daniel Moon
*Attorney, Agent, or Firm*—Nixon & Vanderhye

[57] ABSTRACT

A film cover is heat-sealed to the open end of containers and cut from a film stock by a cam-actuated, orbitally moving knife blade which severs the film stock along a circumferential region closely adjacent the container's open end. A major extent of the orbital movement of the cam-actuated knife blade about the open-ended container is preferably substantially circular (to closely conform to the circular cross-sectional geometry of open-ended containers to be film-covered). However, a minor segment of the knife blade's orbital movement is cam-actuated so as to follow a segment of an arcuate non-circular (e.g., elliptical) path to form a protruding tab on the film cover so as to allow a consumer to more easily grasp and remove the same. The film is preferably continuously supplied to the sealing and cutting zone, while the waste web (i.e., the film remaining after the film cover has been cut from the film stock) is continuously retrieved from the sealig and cutting zone at substantially constant rates. Meanwhile, discrete sections of the film stock are sequentially indexed into the momentarily stopped within the zone to allow for sealing of the film cover to the open-ended container. During such momentary stoppages, a dancer roll assembly accommodates the continuous supply and retrieval of film stock and waste web to and from the sealing and treating zone, respectively.

15 Claims, 3 Drawing Sheets

APPARATUS AND METHOD FOR HEAT-SEALING A FILM COVER TO OPEN ENDED CONTAINERS

FIELD OF INVENTION

The present invention relates generally to packaging apparatus and methods. More specifically, the present invention relates to methods and apparatus which apply a film covering onto the open ends of containers of the type which are used to package edible products (e.g., dairy products and the like).

BACKGROUND AND SUMMARY OF THE INVENTION

Numerous edible products, such as dairy products (e.g., yogurt, ice cream, cottage cheese, and the like), are packaged for retail sales in open-ended containers which are closed by a resealable lid. Resealable lids have for many years been employed in the food-packaging industry as a means to ensure that the consumer is provided with sanitary, unadulterated edible products. However, due to several well publicized criminal events that involved the intentional adulteration of packaged products, there has been an increased effort to provide enhanced tamperproof and/or tamper-evident packaging to supplement the protection which is afforded by resealable lids alone.

One proposal that has gained industry acceptance in terms of its enhanced tamperproof and/or tamper-evident functions is to heat-seal a film barrier of plastics material (preferably transparent) onto the upper circumferential edge of open-ended foodstuff containers. A resealable lid may then be placed onto the now film-sealed end of the container so that the lid/film seal collectively provide enhanced protection of the container contents. Moreover, a consumer may more easily be alerted to the possibility of the contents possibly being adulterated simply by visually inspecting the integrity of the film seal upon removal of the lid. If no visual evidence of film breakage, tearing or the like can be discerned, the consumer can have a greater level of confidence that the contained product will not have been illegally tampered with.

As can be appreciated, the advent of film seals in conjunction with conventional resealable lids has presented the packaging industry with special problems in terms of economically mass producing product-filled containers having both a heat-sealed film barrier and a conventional resealable lid. For example, U.S. Pat. Nos. 3,838,550 and 4,065,908 each issued to Martin Mueller, disclose heat-sealing a generally rectangularly shaped film barrier to the upper edge of open ended containers. The rectangularly shaped film barriers are, according to the techniques of the '550 Patent, preferably cut along mutually orthogonal longitudinal and latitudinal lines from a continuous web of film material. Once heat-sealed to the upper edge of the container, the four corners of the film extend below the upper container edge (see FIG. 1 in each of the '550 and '908 Patents) so as to provide gripping mechanisms which allow a consumer to more easily remove the film seal when access to the product contents is desired.

While the techniques disclosed in the '550 and '908 Patents certainly provide a measure of enhanced tamperproof and/or tamper-evident characteristics to the container, there are some improvements that could be made. For example, the rectangular configuration of the film necessarily forms four corners which, when applied to a generally cylindrical or slightly conical container, are each visible below the resealable lid (e.g., as shown in FIG. 1 in the '908 Patent). Visibility of the four corners on the exterior of the container may not always be aesthetically desirable and thus may detract from a consumer selecting a particular manufacturer's product in favor of a competitor's product.

One more aesthetically acceptable solution that has been proposed is to provide the film seal with a single tab element as represented by U.S. Pat. No. 4,176,507 to Derek V. Mancini. According to the technique disclosed in the '507 Patent, a preformed "daisy-chain" series of tabbed lids are fed to a heat-sealing station, where they are momentarily positioned in registry with an open end of a container (e.g., a single-serve condiment container), heat-sealed to the container end, and then severed from the adjacent tabbed lid. The resulting film-sealed container thus has an integral single tab which provides a consumer with a means to grip and remove the film so as to enjoy the contents of the container.

The technique disclosed in the '507 Patent, however, necessarily depends upon the formation and supply of an especially configured "daisy-chain" series of tabbed film lids. Thus, an especially adapted upstream fabrication apparatus which forms the series of such "daisy-chain" series of tabbed film lids from stock film sheets is needed, thereby increasing production costs.

It would therefore be highly desirable if standard film stock could be employed during packaging operations so as to produce economically product-filled containers with a heat-sealed barrier film cover having an integral pull tab. It is towards providing such a technique that the present invention is directed.

According to the present invention, methods and apparatus are provided for applying tamper-evident film seals onto the open ends of containers using a continuously advancing film stock. More particularly, the present invention provides packaging methods and apparatus which simultaneously heat-seals a film to a container and then circumferentially cuts the film around the container's upper edge. As a result, the perimeter of the heat-sealed film closely conforms to the circumferential geometry of the open container end.

The circumferential cut is performed using a cam-articulated orbiting cutting blade. The orbital path of the cutting blade around the circumference of the container's upper edge (i.e., an orbit about the longutidinal central axis of the container) is controlled by a camming mechanism which preferably forms a generally elliptical protrusion near the end of the blade's orbit. This protrusion thus forms a convenient pull tab for the tamper-evident film which more easily permits a consumer to access the container's contents.

The film stock is advanced into registry with the containers using a novel film-advancing system according to the present invention. In this regard, the film stock is supplied to a heat-sealing station by means of a continuously driven supply roll. On the other hand, the waste film (e.g., the webbing that remains after removal of the tamper-evident film seals) is taken up by means of a continuously driven take-up roll.

Discrete sections of the supplied film stock are synchronously indexed with an advancing group of containers by means of a dancer roll system which serves as a mechanical buffer between the continuously advancing film stock from the supply roll and the continuously retreating waste web onto the take-up roll. That is, the continuously advancing film stock is temporarily accommodated by means of a substantially horizontally moving supply dancer roll which essentially allows the advancing film to accumulate. At the same time, however, previously accumulated waste film webbing is continuously being paid-out at the same rate by means of a substantially horizontally moving discharge dancer roll. The net effect of these dancer rolls is to allow a length of film stock therebetween to be stopped momentarily in a registered positioned above a stationary set of open containers that have been indexed into position. During this momentary stoppage, the heat sealing and film-cutting functions can be accomplished, after which the now heat-sealed containers are advanced and the cycle repeats itself.

Thus, the present invention provides economical techniques for providing open-ended product-filled containers with heat-sealed film covers that are well suited for implementation on a mass production scale. Further aspects and advantages of this invention will, however, become more clear after careful consideration is given to the detailed description of the preferred exemplary embodiments which follow.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
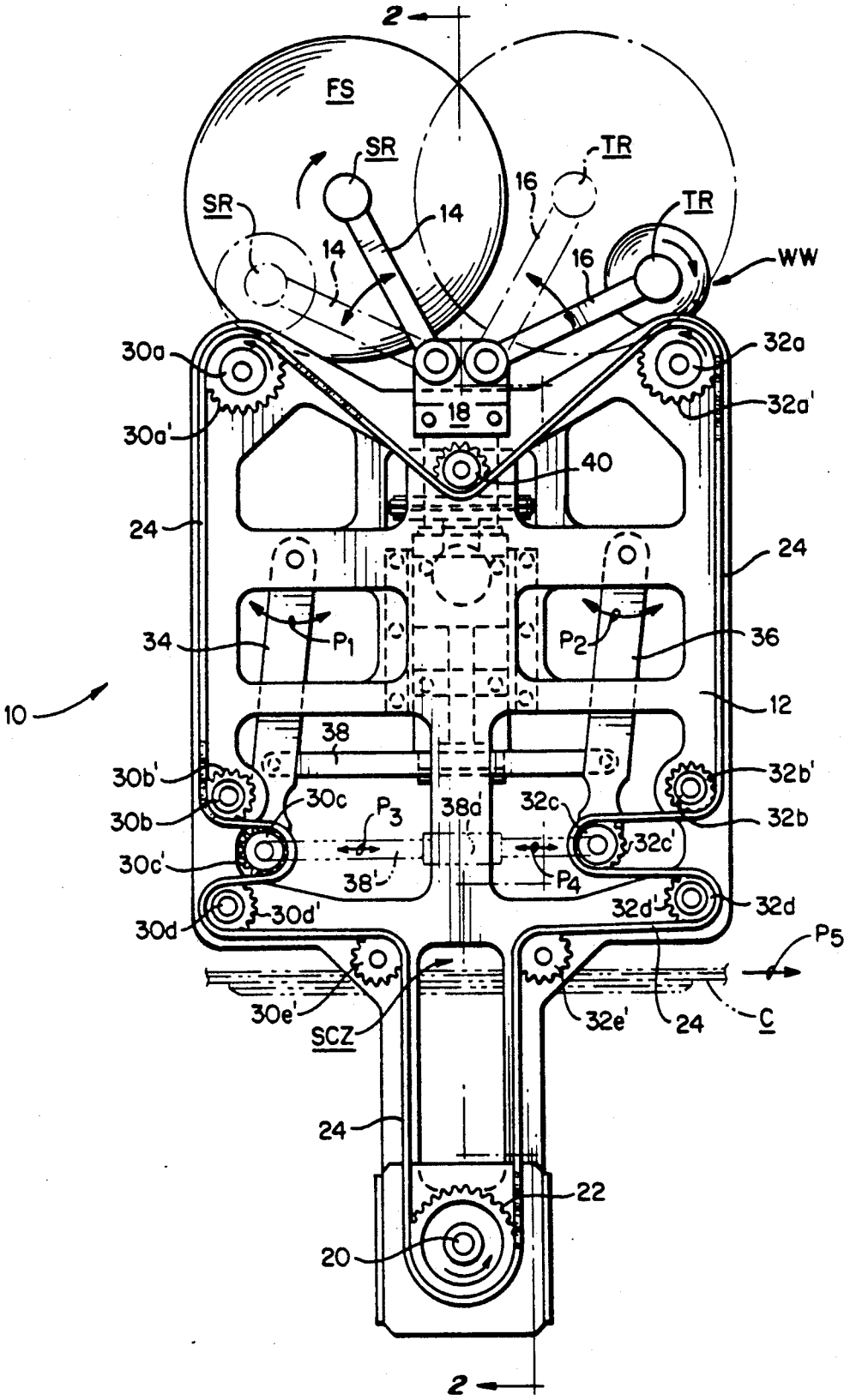
FIG. 1 is a partial side elevational view of an apparatus according to the present invention.
Figure 2:
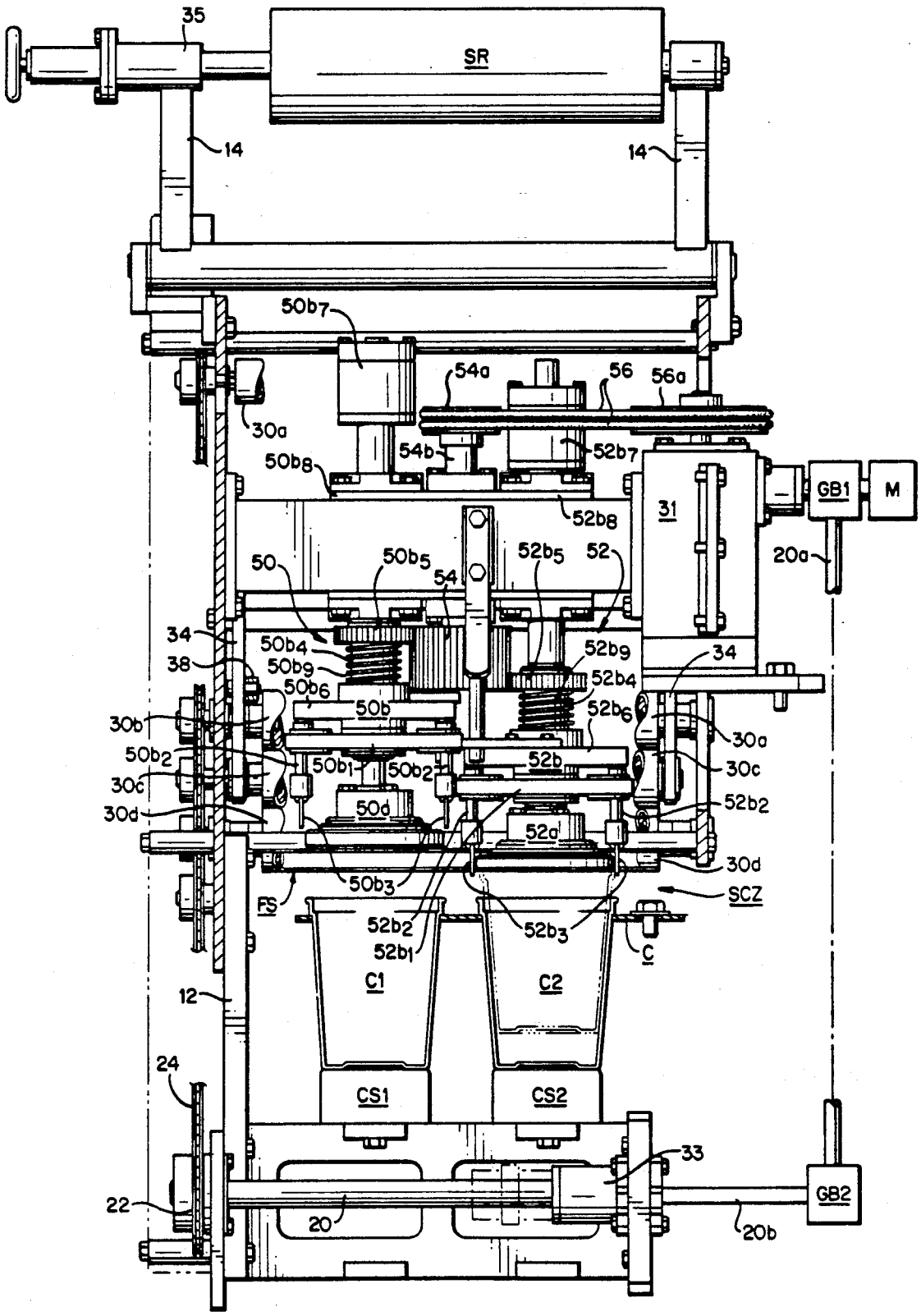
FIG. 2 is a cross-sectional front elevational view of the apparatus depicted in FIG. 1 as taken along line 2—2 therein; and FIGS. *3a-3c* depict schematically the sequence for heat-sealing a film cover to an open end of a generally tubular open-ended container.

A preferred embodiment of the apparatus 10 according to the present invention is depicted in accompanying FIGS. 1 and 2. AS is seen particularly from accompanying FIG. 1, the apparatus 10 is generally comprised of a frame 12 which itself may be supported vertically above the ground in operative relationship to a conveyor C by any suitable rigid structural supports (not shown).

The apparatus 10 necessarily includes a supply roll SR and take-up roll TR for respectively supplying film stock to, and taking-up waste film web from, the sealing and cutting zone SCZ (see FIG. 2). The supply and take-up rolls SR, TR are journally supported at a terminal end between paired roll support arms 14, 16, respectively. The proximal ends of the support arms 14, 16 are, in turn, pivotally coupled to an upper support block 18 so as to allow the arm pairs 14, 16 to pivot as the diameter of the film which is rolled upon the supply roll SR and take-up roll TR respectively decreases and increases as shown in phantom line in FIG. 1.

The lower end of the frame 12 journally supports a transverse indexing shaft 20 (see FIG. 2) which includes an indexing sprocket 22 at its terminal end engaged with an endless drive chain 24 as can be seen more clearly in FIG. 1.

As can also be observed in FIG. 1, the endless drive chain 24 is operatively coupled to a set of rollers 30*a*–30*d* associated with the film supply side of the apparatus 10, and a set of rollers 32*a*–32*d* associated with the waste web take-up side of the apparatus 10. The rollers 30*a*–30*d* and 32*a*–32*d* each transversely extends in the cross-machine direction (i.e., perpendicular relative to the conveyance direction —arrow P5 in FIG. 1 —of the conveyor C).

The rollers 30*a*, 32*a* are journally supported by the frame 12 and are each respectively in contact with the circumferential surface of the film stock and waste web which is wound upon the supply and take-up rollers SR and TR. Driven motivation to rotate the rollers 30*a*, 32*a* in a counterclockwise direction may be supplied an output shaft (not shown) associated with the gear box 31 which receives its drive power from a motor M (see FIG. 2). Thus, since continuous driven motivation is supplied to each of the rollers 30*a*, 32*a*, this continuous driven motivation will be transferred to the rollers 30*b*, 32*b* by means of the endless drive chain 24 being intermeshed with their respective roller sprockets 30*b'*, 32*b'*.

The shaft 20 is coupled to a mechanical indexer 33 as shown in FIG. 2 which operates periodically in a timed relationship to be described below to cause a fresh section of film stock FS to be advanced into the sealing and cutting zone SCZ. Thus, during the operation of the indexer 33, the rollers 30*d*, 32*d* will each be incrementally rotated due to their being operatively coupled by endless drive chain 24 to the indexing sprocket 22 of shaft 20 via sprockets 30*d'*, 32*d'*, respectively, and idler sprockets 30*e'*, 32*e'*. Driven motivation for the indexer 33 is provided by power take-off shafts 20*a*, 20*b* coupled to the output drive of motor M via gear boxes GB1 and GB2.

The contact between the continuously rotating rollers 30*a*, 32*a* and the supply and take-up rolls SR and TR, respectively, will cause the latter to rotate in a clockwise direction as viewed in FIG. 1. As a result, the rollers 30*a*, 32*a* provide an indirect drive for the rolls SR and TR, respectively, so as to continuously unwind the film stock from the roll SR and continuously wind the waste film web onto the roll TR. Of course, when the supply of film stock on roll SR is exhausted, the operation of apparatus 10 must temporarily be suspended so that the exhausted supply roll SR can be interchanged with a replenished supply roll SR having a fresh supply of film stock may be provided. At that time, an empty take-up roll TR may also interchanged for the take-up roll TR having its full complement of waste web wound thereon. A quick-change fitting 35 (see FIG. 2) is most preferably provided for each of the supply and take-up rolls SR and TR, respectively.

The vertically paired rollers 30*b*, 30*d* and 32*b*, 32*d* are each stationary and journally coupled to the frame 12, respectively. The roller pairs 30*b*, 30*d* and 32*b*, 32*d* thus serve as guide rollers for the supply dancer roller 30*c* and take-up dancer roller 32*c*, respectively. The supply and take-up dancer rollers 30*c* and 32*c*, respectively, are each pendulously supported at the terminal ends of arm pairs 34, 36, respectively (only one arm of each arm pair 34 and 36 being seen in FIG. 1) so as to allow the arms 34, 36 to pivotally move relative to the frame 12 (arrows P1 and P2 in FIG. 1) which, in turn, responsively causes the rollers 30*c* and 30*c* to move reciprocally in forwardly and rearwardly directions substantially horizontally parallel (arrows P3 and P4 in FIG. 1) to the travel direction of the conveyor C (arrow P5 in FIG. 1). Synchronous pendulous movement of the arms 34, 36 (and hence the rollers 30*c*, 32*c*, respectively) is provided by a rigid tie rod 38 which is pivotally coupled at each of its ends to the arms 34 and 36, respectively.

The length of the arms 34 and 36 is such that the movement of the dancer rollers 30*c*, 32*c* is along a very shallow arc so as to substantially be rectilinear between their travel extents. Thus, although the dancer rollers 30*c*, 32*c* are shown as being supported for pendulous movement, they could likewise be supported in a functionally equivalent manner by providing a slide rail assembly 38*a*'which supports a tie rod 38' connected at each of its ends to the rollers 30*c*, 32*c* for reciprocal rectilinear movements (see the double dash line representation thereof in FIG. 1). In both structural arrangements described above, however, the dancer rollers 30*c*, 32*c* move in concert with one another due to the the mechanical interconnection provided by the tie rod.

The rollers 30*b*–30*d* constitute the dancer roll assembly associated with the film supply side of the apparatus 10, whereas the roller 32*b*–32*d* constitute the dancer roll assembly associated with the waste web take-up side of the apparatus 10, the purpose and function of which will become evident from the discussion which follows. Suffice it to say here, however, that since the rollers 30*b*, 32*b* are each being continuously rotated, whereas the rollers 30*d*, 32*d* are each intermittently rotated during operation of the indexer 33 as described above, the dancer rolls 30*c*, 32*c*, due to their simultaneous reciprocal motions, will serve as a mechanical buffer or lost motion assembly for the endless chain 24 and the film stock FS. As a result, the film stock FS is allowed to momentarily stop within the sealing and cutting zone SCZ.

The idler sprockets 30*e*' and 32*e*' serve to guide the endless chain 24 to and from the driven indexing sprocket 22 associated with the indexing shaft 20. The drive chain 24 is further intermeshed with a tensioning sprocket 40 located substantially centrally between and below the sprockets 30*a*' and 32*a*'. The tension sprocket 40 may be selectively adjusted so that the proper tension is maintained on the endless chain 24.

The path of the film after being unwound from the supply roll SR is hidden in FIG. 1 due to the presence of the frame 12. However, the path follows generally that taken by the drive chain 24 around the rollers 30*a*–30*d* on the opposite (hidden) side of the frame 12. Similarly the path taken by the waste web on the take-up side of the apparatus 10 generally follows that taken by the drive chain 24 around the rollers 32*d*–32*a*. Thus, a linear section of the film stock is tensioned between the roller 30*d* on the one hand and roller 32*d* on the other hand within the sealing and cutting zone SCZ.

The sealing and cutting zone SCZ is essentially comprised of one or more sealing and cutting assemblies. In the embodiment shown in FIGS. 1 and 2 a pair of side-by-side sealing and cutting assemblies 50, 52 are depicted since the apparatus 10 shown in the accompanying FIGURES is especially adapted to sealing and cutting a film stock simultaneously with respect to a pair of containers C1 and C2 being conveyed on the conveyor C. However, it should be recognized that the principals of the present invention could similarly be embodied in apparatus using a single sealing and cutting assembly, or a greater number of sealing and cutting assemblies than are depicted in the accompanying FIGURES.

When a number of sealing and cutting assemblies are provided, they each preferably operate substantially simultaneously so that a corresponding number of containers may simultaneously be provided with a heat-sealed film cover. However, for purposes of discussion and clarity of understanding, the sealing and cutting assembly 50 is depicted in FIG. 2 in a "ready" state, whereas the sealing and cutting assembly 52 is depicted in an "operational" state.

The sealing and cutting assemblies 50, 52 include a heat-sealing head 50*a*, 52*a*, each of which is sized and configured to conform to the circumference of the upper edge of the containers C1 and C2, respectively. The heat-sealing heads 50*a*, 52*a* are heated by any suitable means (e.g., electrical resistance heaters) so as to cause a circumferential portion of the film stock FS in registry with the upper edge defining the open end of the containers C1 and C2 to be at least partially plasticized. As a result, the circumferential regions of the film stock are heat-sealed to the upper edge of the containers C1 and C2. Since heat-sealing of plastics film is in and of itself well known, further discussion as to the manner in which the film adheres to the upper circumferential edge of the containers C1 and C2 is believed unnecessary for a full understanding of this invention by those skilled in the plastics film heat-sealing art.

The sealing and cutting assemblies 50, 52 also include respective cutting subassemblies 50*b*, 52*b*. These cutting subassemblies are, in turn, comprised of a rotatable drive plate $50b_1$, $52b_1$ which dependently carries a radially opposed pair of blade-holders $50b_2$, $52b_2$ holding respective knife blades $50b_3$, $52b_3$. The drive plates $50b_1$, $52b_2$ are coupled to sleeve shafts $50b_4$, $52b_4$ which, in turn, are splined via gears $50b_5$, $52b_5$, respectively, to pinion gear 54. The pinion gear 54 is operatively coupled to a pulley 54*a* on a shaft 54*b*. Drive belts 56 connect the continuously rotating output pulley 56*a* (associated with a power take-off shaft 56*b* of gear box 31) to the pulley 54*a* so as to, in turn, continuously drive the pinion gear 54. In such a manner, constant rotational motion is imparted to the plates $50b_1$, $52b_1$ to thereby cause the knife holders $50b_2$, $52b_2$ and their respective knife blades $50b_3$, $52b_3$ to orbit continuously the circumference of the cups C1 and C2, respectively.

The knife holders $50b_2$, $52b_2$ are mounted to the plates $50b_1$, $52b_1$ so as to be reciprocally radially displaceable towards and away from the longitudinal axis of the shafts $50b_4$, $52b_4$, respectively. The upper ends of the knife holders $50b_2$, $52b_2$ are respectively positioned within an endless race (not shown) defined by the cam plates $50b_6$, $52b_6$. The cam plates $50b_6$, $52b_6$, are respectively coupled to the shafts $50b_4$, $52b_4$ so as to be stationary relative to the orbital movements of the knife holders $50b_2$, $52b_2$ as was described previously.

The races defined in the cam plates $50b_6$, $52b_6$ are such that the upper end of the knife holders $50b_2$, $52b_2$ follow a substantially circular orbit to responsively cause their respective knife blades $50b_3$, $52b_3$ to orbit circularly adjacent the upper edges of the containers C1 and C2, respectively. However, a minor portion of the race is preferably comprised of a non-circular (e.g., elliptical) segment so that the knife holders $50b_2$, $52b_2$ will follow a corresponding non-circular (e.g., elliptical) segment during their orbit. As a result of this non-circular (e.g., elliptical) segment being defined in the race, the knife blades $50b_3$, $52b_3$ will cut a non-circular (e.g., elliptical) tab from the film stock FS which extends outwardly from the upper edge of the containers C1 and C2, respectively. Thus, the tab that results provides a convenient member which a consumer may grip to more easily remove the film cover when access to the container contents is desired.

As mentioned briefly above, the sealing and cutting assemblies 50, 52 are respectively shown in "ready" and "operational" states. The difference between these states is that in the former, the sealing and cutting assembly is raised relative to the film stock FS, whereas in the latter, the sealing and cutting assembly is lowered into operative engagement with the film stock FS. Raising and lowering of the sealing and cutting assemblies 50, 52 is accomplished by means of pneumatically controlled loaded air cylinder actuators 50$b_7$, 52$b_7$, as well as main pneumatic actuators 50$b_8$, 52$b_8$.

Compression springs 50$b_9$, 52$b_9$ serve to ensure that the cam plates 50$b_6$, 52$b_6$ are properly positioned relative to the knife holders 50$b_2$, 52$b_2$ of the plates 50$b_1$, 52$b_1$ so that the upper ends of the knife holders 50$b_2$, 52$b_2$ reliably follow the race defined in the cam plates 50$b_6$, 52$b_6$. Furthermore, the compression springs 50$b_9$, 52$b_9$ allow the cam plates 50$b_6$, 52$b_6$ to be moved vertically relative to their associated plates 50$b_1$, 52$b_1$ to permit positional adjustment and/or replacement of the knife holders 50$b_2$, 52$b_2$ and their associated knife blades 50$b_3$, 52$b_3$.

As mentioned briefly above, the knife blades 50$b_3$, 52$b_3$ continuously orbit relative to the longitudinal axes of the sealing and cutting assemblies 50*b*, 52*b*, respectively. Therefore, operation of the actuators 50$b_7$, 52$b_7$ and 50$b_8$, 52$b_8$ is controllably timed by any suitable pneumatic control system well known to those skilled in the art. In this regard, the assemblies 50*b*, 52*b* are controllably moved between their "ready" state (i.e., when the film stock FS is not capable of being cut by the orbiting knife blades 50$b_3$, 52$b_3$) and their "operational" state (i.e., when cutting of the film stock FS occurs due to the orbiting knife blades 50$b_3$, 52$b_3$) synchronously with movement of the containers C1 and C2 into registry therewith.

Figure 3C:
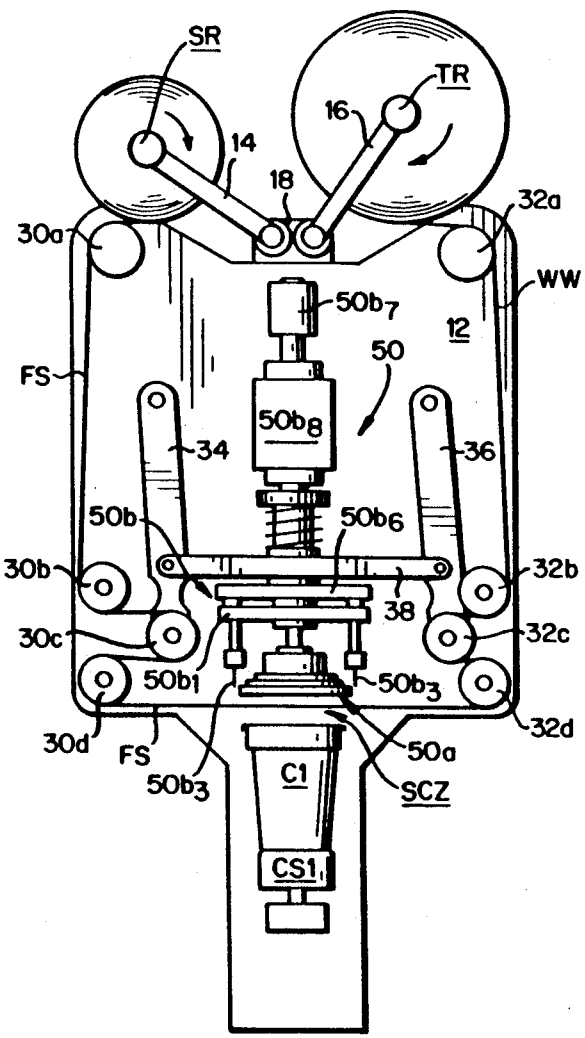
Figure 3B:
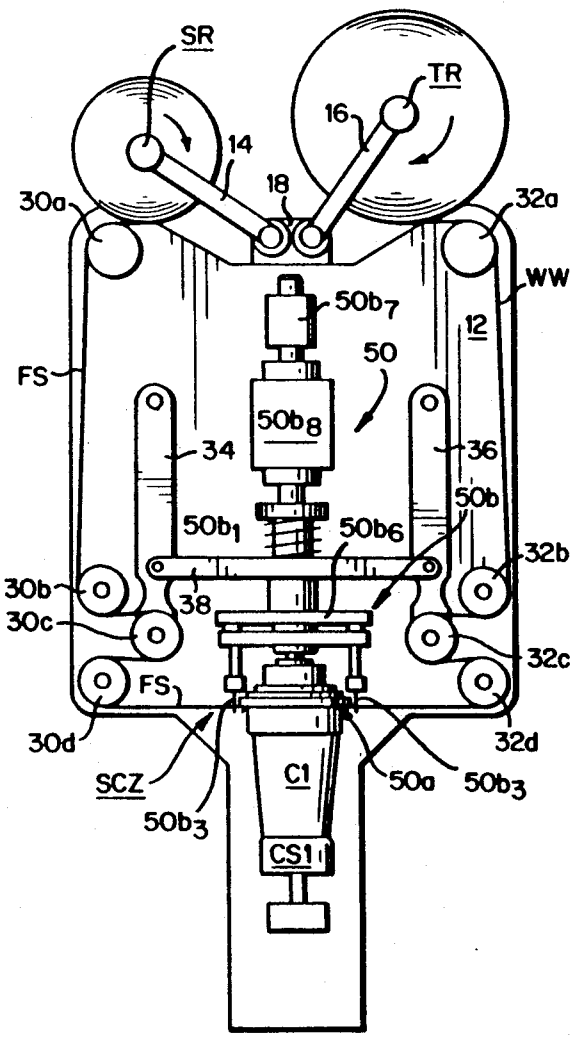
Figure 3A:
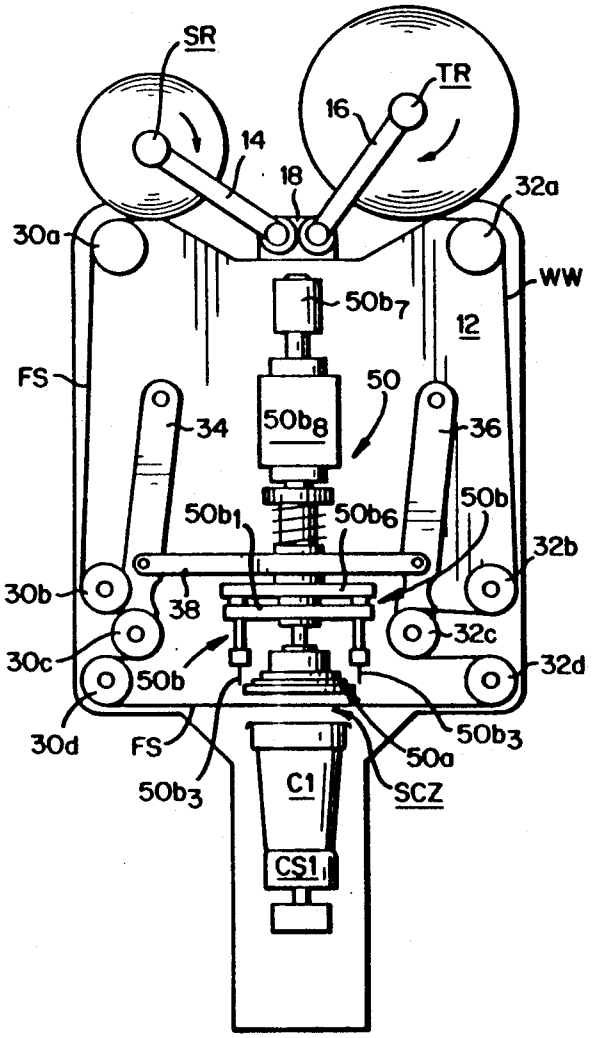

The operation of the apparatus 10 as described above, particularly the manner in which the film stock FS is supplied and taken-up from the sealing and cutting zone SCZ will be described with reference to the accompanying FIGS. 3*a*–3*c*. It will, of course, be understood that FIGS. 3*a*–3*c* depict the apparatus 10 schematically and, moreover, show only sealing and cutting assembly 50 for ease of discussion. Sealing and cutting assembly 52 (or any other sealing and cutting assembly that may be provided with the apparatus) would thus function in a manner similar to that described below with reference to sealing and cutting assembly 50.

Accompanying FIG. 3*a* depicts the apparatus 10 in a state whereby a container C1 has been conveyed via the conveyor C (not shown in FIGS. 3*a*–3*c*, but see FIGS. 1 and 2) so that its upper open end is in registry with the sealing and cutting assembly 50. In this connection, the conveyor C is preferably driven by its own indexing system which is controllably synchronized with the operation of the apparatus 10 according to this invention to ensure that containers will be sequentially advanced into the sealing and cutting zone in timed relationship to the operation of the sealing and cutting assembly 50.

The container C1 rests upon a pneumatically actuated container support CS1 (a similar container support CS2 being provided for container C2, see FIG. 2) which is movable vertically between a retracted position as shown in FIG. 3*a* (i.e., so that the upper edge of container C1 is spaced from the film stock in the sealing and cutting zone CSZ) to an extended position as shown in FIG. 3*b* (i.e., so that the upper edge of container C1 is in contact with the film stock in the sealing and cutting zone SCZ —see also, the phantom line representation for cup C2 in FIG. 2).

At the time the cup C1 is advanced into registry with the sealing and cutting assembly 50 (i.e., by an indexing mechanism associated with the conveyor C), a fresh length of film stock FS will have been advanced by means of the driven indexer 33 coupled operatively to the endless chain 24 via the sprocket 22 (see FIG. 2). Thus, as was described previously, the rollers 30*d*, 32*d* will each be rotated counterclockwise (in the direction viewed in FIG. 3*a*) during the time that the indexer 33 operates thereby advancing a fresh section of the film stock FS into the sealing and cutting zone SCZ.

It will be remembered that the rollers 30*a*, 32*a* and 30*b*, 32*b* are continuously being rotated in a counterclockwise direction. As a result, the film stock FS is continuously being paid out from the supply wound upon the supply roll SR, whereas the waste web WW is continuously being taken up by the take-up roll TR. However, the film stock FS in the sealing and cutting zone SCZ (i.e., between the rollers 30*d*, 32*d*) is momentarily stationary to allow heat-sealing and cutting by means of the sealing and cutting assembly 50. To accomplish this, the dancer rolls 30*c*, 32*c* will begin simultaneously to move substantially horizontally in a rightward direction as viewed in FIG. 3*a* due to the accumulated amount of waste web being drivenly taken-up by the take-up roll TR. The take-up dancer roll 32*c* is thus responsively moved rightwardly as viewed in FIG. 3*a*. While this is occurring, the fresh film stock FS is being continuously supplied to the feed dancer roll 30*c*. However, since the feed dancer roll 30*c* is slaved to the take-up dancer roll 32*c* during this phase of the operation, the fresh film stock is accumulated by movement of the feed dancer roll 30*c* in a rightward direction as viewed in FIG. 3*c*.

With a fresh section of film stock FS in registry with the upper edge of the container C1, the container support CS1 is actuated so as to move the upper end of the container C1 up to the film line. The sealing and cutting assembly 50 is then lowered into an operational state as shown in FIG. 3*b*. In this connection, the movement of the cup upwardly toward the film line occurs just prior to movement of the sealing and cutting assembly 50 so as to provide support for the film when the heat sealing head 50*a* is moved into contact with the film. As a result, the film is prevented from bowing and/or stretching under the weight of the heat sealing head 50*a*.

It will be observed, for example, in FIG. 2, that the knife blades 50$b_3$ are vertically raised relative to the heat sealing head 50*a* when the sealing and cutting head 50 is in a "ready" state but are extended below the bottom edge of the heat sealing head 50*a* when in an "operational" state so as to cut the film stock FS. Thus, when the sealing and cutting head 50 is lowered, the actuators 50$b_7$, 50$b_8$ will respectively cause the heat sealing head 50*a* and the knife blades 50$b_3$ to be lowered substantially concurrently until the the heat sealing head 50*a* comes into pressing contact with the film stock FS against the upper edge of the raised container C1. At this time, the actuator 50$b_7$ maintains the pressure of the heat sealing head 50*a* against the upper edge of the container C1 so as to positionally restrain the film stock. Meanwhile, the knife blades 50$b_3$ continue to be lowered by the actuator 50$b_8$ (i.e., by lowering the plates 50*b* and 50$b_6$) until they penetrate through the film stock FS.

Since the knife blades 50$b_3$ continuously orbit in the manner described above, the film will begin to be cut closely adjacent to the circumference of the open end of container C1. Thus, the sealing and cutting assembly 50 is maintained in its "operational" state as shown in FIG. 3*b* (i.e,. due to controllably timing the functioning of the actuators 50$b_7$ and 50$b_8$) for a time such that each of the blades 50$b_3$ travels at least one-half the circumferential distance around the container C1 so as to ensure a complete orbital severance of the now heat-sealed film cover from the remaining waste web WW.

It will be appreciated that during the operation described above with reference to FIG. 3*b*, the feed and take-up dancer rolls 30*c*, 32*c*, respectively, continue to move rightwardly due to the continuously driven paying-out of fresh film stock FS at the supply roll SR and the continuous driven retrieval of the waste web WW at the take-up roll TR. Thus, at the time when heat-sealing and cutting is finished such that the sealing and cutting assembly 50 is returned to its "ready" state, the dancer rolls 30*c*, 32*c* will have traveled to their rightwardmost extent. Such a state during the operation is depicted in accompanying FIG. 3*c*.

At this time, the indexer 33 is operated at a rate faster than the rate which film stock is being paid out at the supply roll SR and being retrieved at the take-up roll TR. This operational rate difference results in the feed dancer roll 30*c* being moved leftwardly, which then slaves the take-up dancer roll 32*c* (due to the interconnection therebetween via tie rod 38) so that it likewise moves leftwardly. The differential rate of movement of the feed stock FS by virtue of the indexer 33 thereby causes the film stock FS accumulated by means of the feed dancer roll assembly 30*b*–30*d* to be diminished, while simultaneously allowing the waste web WW to be accumulated by means of the take-up dancer roll assembly 32*b*–32*d*.

The indexer 33 operates until the feed dancer roll 30*c* has moved to its leftwardmost extent as viewed in FIG. 3*a*, whereby the film stock FS that had been accumulated within the supply dancer roll assembly 30*b*–30*d* is substantially completely paid out, but the waste web WW that is accumulated within the take-up dancer roll assembly 32*b*–32*d* is substantially at a maximum. At this time, the indexer 33 stops the shaft 20 thereby again momentarily stopping advancement of the film stock within the sealing and cutting zone. As a result, the apparatus 10 returns to the state of operation depicted in FIG. 3*a*, at which time the cycle described above repeats.

Although the heat sealing and cutting assembly 50 has been shown and described above in connection with structures which enable substantially simultaneous heat-sealing of a film cover to an upper edge of a container and cutting of the cover from the film stock, the structures and functions attributable to the heat-sealing head 50*a* and the cutting assembly 50*b* could, however, be separated. That is, it is entirely conceivable (and within the scope of this invention) to provide the heat sealing head at a heat sealing station upstream of the cutting assembly positioned at a cutting station within the sealing and cutting zone SCZ. In such a case, the conveyor C would be controllably indexed by any suitable control scheme so that the containers are sequentially moved into position at each of the sealing and cutting stations during the momentary stoppage of the film stock FS within the sealing and cutting zone SCZ.

It will thus now be appreciated that the present invention provides several advantages in terms of flexibility during manufacture of filled containers to provide a heat-sealed film cover. That is, the cam plates can easily be exchanged quickly so that different container sizes can be accommodated without significant modification occurring to the apparatus. In addition, the individual knife blades can easily be exchanged when dulled after repeated cutting operations. Furthermore, the dancer roll assemblies allows substantially constant tension to be maintained on the film stock while, at the same time, permitting smooth momentary stoppages of a film stock section in registry with the next containers to be heat-sealed.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for heat sealing a film cover to an open-ended container comprising sealing and cutting means for simultaneously (i) heat-sealing a circumferential region of film stock to an upper edge of the container and (ii) cutting the film stock circumferentially adjacent to the heat-sealed film stock region, wherein said sealing and cutting means includes:

a heat sealing head which heat-seals the film stock region to the upper edge of the container;

at least one knife blade which is orbitally movable circumferentially adjacent to the upper edge of the container so as to sever the film stock exteriorly of the heat-sealed film stock region, whereby a film cover over the open-ended container is formed;

a camming plate which defines an orbital path to be followed by said at least one knife blade having a major portion which is circular and a minor portion which is non-circular;

a knife blade holder for holding said at least one knife blade in opposition to the film stock to be cut and having a follower operatively coacting with said camming plate; and a drive assembly for moving said knife blade holder, and thereby said at least one knife blade held thereby, along the orbital path defined by said camming plate, and wherein said non-circular portion of said orbital path causes said at least one knife blade to orbit in a non-circular manner to cut a tab extending outwardly relative to said open-ended container from said film stock.

2. Apparatus as in claim 1, wherein said sealing and cutting means is positionally disposed at a sealing and cutting zone of the apparatus, and wherein the apparatus further comprises:

a supply roll for supplying fresh film stock sections to the sealing and cutting zone;

a take-up roll for taking up waste film stock sections from the sealing and cutting zone;

drive means for continuously rotating said supply and take-up rolls at substantially constant rates so that said fresh film stock and waste film stock sections are continuously supplied to and retrieved from the sealing and cutting zone, respectively; and dancer roll means for momentarily stopping advancement within the sealing and cutting zone of the fresh film stock sections while simultaneously accommodating the continuous supply to and retrieval from the sealing and cutting zone of other fresh film and waste film stock sections, respectively.

3. Apparatus as in claim 2, wherein said dancer roll means includes supply and take-up dancer roll assemblies, and a tie rod for interconnecting said supply and dancer roll assemblies, wherein said supply dancer roll assembly having a pair of opposed supply rolls and a reciprocally movable supply dancer roll disposed therebetween, and wherein said take-up dancer roll assembly having a pair of opposed take-up rolls and a reciprocally movable take-up dancer roll disposed therebetween, and wherein said supply and take-up dancer rolls move as a unit due to said interconnection provided by said tie rod.

4. Apparatus as in claim 3, wherein said dancer roll means includes indexing means for periodically advancing fresh film stock sections into said sealing and cutting zone.

5. Apparatus as in claim 1 or 2, wherein said sealing and cutting means includes mounting means for mounting said heat-sealing head and said at least one knife blade for movements toward and away from said film stock.

6. Apparatus as in claim 1, wherein said camming plate is stationary and said knife blade holder is rotationally movable relative thereto by said drive assembly.

7. Apparatus as in claim 1, wherein said camming plate defines a race which is followed by said knife blade holder during rotational movements thereof by said drive assembly.

8. Apparatus as in claim 1, wherein said sealing and cutting means includes mounting means for mounting said heat sealing head and said at least one knife blade for substantial concurrent movements towards and away from said film stock.

9. Apparatus as in claim 8, wherein said drive assembly includes a driven pinion gear, and a drive gear intermeshed with said pinion gear so as to be driven thereby, and wherein said mounting means is splined to said pinion gear by means of said intermeshed drive gear to allow for movements of said heat sealing head and said at least one knife towards and away from said film stock.

10. Apparatus for heat-sealing a film cover to an open-ended container at a sealing and cutting zone comprising:

a supply roll for supplying fresh film stock to the sealing and cutting zone;

a take-up roll for taking-up a waste web remaining after the film cover has been cut from the fresh film stock at the sealing and cutting zone;

a heat-sealing and cutting mechanism disposed in the sealing and cutting zone for movements towards and away from the fresh film stock to heat-seal a portion of the film stock to an open end of the container and cut the film stock portion circumferentially adjacent the heat-sealed film stock portion to thereby form a film cover over the open-ended container;

a continuous drive system for continuously driving said supply and take-up rolls at substantially constant rates so that fresh film stock and waste web are continuously supplied to and retrieved from, respectively, the sealing and cutting zone;

an indexing drive system for periodically advancing sections of the fresh film stock into, and discharging sections of the waste web from the sealing and cutting zone, whereby sequential sections of the fresh film stock are momentarily stopped within the sealing and cutting zone in registry with the open-ended containers so that the film cover cut from the film stock sections may be heat-sealed thereto; and a dancer roll assembly for accommodating said continuously supplied and retrieved fresh film stock and waste web, respectively, during sequential momentary stoppages of said fresh film stock sections in the sealing and cutting zone; wherein said sealing and cutting mechanism includes:

at least one knife blade for cutting the film stock;

a camming plate which defines an orbital path adjacent the open end of the container in registry therewith, said orbital path defined by said camming plate having a major circular segment and a minor non-circular segment;

a knife blade holder for holding said at least one knife blade in opposition to the film stock to be cut and operatively coacting with said camming plate, said knife blade holder being rotatably movable so that said at least one knife blade held thereby moves along the orbital path defined by said camming plate, wherein said minor non-circular segment of said orbital path causes said knife to cut a tab from said film which radially extends from said container.

11. Apparatus as in claim 10, wherein said dancer roll assembly includes supply and take-up dancer roll subassemblies, and a tie rod for interconnecting said supply and dancer roll subassemblies, wherein said supply dancer roll subassembly includes a pair of opposed supply rolls and a reciprocally movable supply dancer roll disposed therebetween, and wherein said take-up dancer roll subassembly includes a pair of opposed take-up rolls and a reciprocally movable take-up dancer roll disposed therebetween, and wherein said supply and take-up dancer rolls move as a unit due to said interconnection provided by said tie rod.

12. Apparatus as in claim 10, wherein said camming plate defines a race which is followed by said knife blade holder during rotational movements thereof.

13. Apparatus as in claim 10, wherein said sealing and cutting mechanism includes a driven pinion gear, and a drive gear intermeshed with said pinion gear so as to be driven thereby, and wherein said sealing and cutting mechanism is splined to said pinion gear by means of said intermeshed drive gear to allow for movements thereof towards and away from the film stock.

14. Method for heat-sealing a film cover to an open-ended container comprising the steps of:

supplying fresh film stock to a sealing and cutting zone, and retrieving from the sealing and cutting zone waste web which remains after the film cover has been cut from the fresh film stock;

moving at least one open-ended container into registry with a portion of the fresh film stock in the sealing and cutting zone;

heat-sealing a circumferential region of the fresh film stock portion to the open end of the container in registry therewith; and orbitally cutting the heat-sealed circumferential region from the fresh film stock portion to thereby form the film cover which is heat sealed to the open-ended container; wherein said step of cutting the film stock includes orbitally moving at least one knife blade circumferentially adjacent the open end of the container, whereby said fresh film stock is cut; and wherein said step of orbitally moving said at least one knife blade is practiced by orbitally moving the at least one knife blade along a substantially circular path; and wherein said step or orbitally moving said at least one knife blade is practiced by orbitally moving the at least one knife blade along an arcuate non-circular path which is coextensive with the circular path, thereby forming a protruding tab on the film cover.

15. Method as in claim 14, wherein said fresh film stock and said waste web are each continuously supplied to and retreived from the sealing and cutting zone, and wherein the method further includes:

momentarily stopping the fresh film stock in the sealing and cutting zone to allow for heat sealing and cutting of the film stock to the open-ended container by periodically indexing fresh film stock sections into and discharging waste web section from the sealing and cutting zone, and maintaining tension on the film stock in the sealing and cutting zone during momentary stoppages thereof by continuously accommodating slack film stock and waste web created by the continuous supply of film stock to and continuous removal of the waste web from the sealing and cutting zone.

* * * * *